United States Patent [19]

Pernicka et al.

[11] Patent Number: 5,012,528

[45] Date of Patent: May 7, 1991

[54] VISOR ATTACHMENT FOR SAFETY HELMET

[75] Inventors: Martin Pernicka, Montreal; Mario Gagnon, Outremont, both of Canada

[73] Assignee: Institut De Recherche En Sante Et En . . ., Montreal, Canada

[21] Appl. No.: 486,821

[22] Filed: Mar. 1, 1990

[51] Int. Cl.[5] ..... A42B 3/18

[52] U.S. Cl. ..... 2/10; 2/7; 2/8; 2/424; 2/422

[58] Field of Search ..... 2/6, 9, 10, 410, 422, 2/424, 7, 8

[56] References Cited

U.S. PATENT DOCUMENTS

| | | | |
|---|---|---|---|
| 2,631,286 | 3/1953 | Bowers | 2/10 |
| 2,801,420 | 8/1957 | Malcom, Jr. | 2/9 |
| 3,067,426 | 12/1962 | Tompkins | 2/9 |
| 3,273,164 | 9/1966 | Thomas | 2/10 |
| 3,946,466 | 3/1976 | Sakai | 2/10 |
| 4,040,123 | 8/1977 | Williams | 2/10 |
| 4,075,715 | 2/1978 | Cowgill | 2/6 |
| 4,109,320 | 8/1978 | Anderson | 2/10 |
| 4,442,551 | 4/1984 | Hellberg | 2/10 |
| 4,479,738 | 10/1984 | Kubnick | 2/424 |
| 4,639,950 | 2/1987 | Palmaer | 2/422 |

FOREIGN PATENT DOCUMENTS

| | | | |
|---|---|---|---|
| 290293 | 11/1988 | European Pat. Off. | 2/410 |
| 2365934 | 5/1978 | France | 2/424 |
| 2532528 | 3/1984 | France | 2/424 |
| 2015868 | 9/1979 | United Kingdom | 2/10 |
| 8603656 | 7/1986 | World Int. Prop. O. | 2/10 |

*Primary Examiner*—Werner H. Schroeder
*Assistant Examiner*—Michael A. Neas
*Attorney, Agent, or Firm*—Longacre & White

[57] ABSTRACT

The disclosure herein describes a visor attachment for use in combination with a conventional safty helmet wherein the visor is pivotally mounted at the back of the helmet; when used, such helmet is thus worn front-to-back. The attachment body has two side extensions which are adapted to fit into rim slots usually provided in opposite sides of a conventional helmet. These extensions each include a manually releasable connecting member which engages the slot, allowing the visor attachment to be easily removed from the helmet.

12 Claims, 4 Drawing Sheets

VISOR ATTACHMENT FOR SAFETY HELMET

FIELD OF THE INVENTION

The present invention relates to a visor attachment for use in combination with a conventional safety helmet.

BACKGROUND OF THE INVENTION

Several suggestions have been made for providing a protective visor to a safety helmet as a replacement of safety goggles which are considered less than satisfactory. In the field of mining, for example, where fragments of materials are sometimes sprayed into a miner's face, eye protection is essential. Similar protection is important in other fields of work in which, if a visor is not used, the result can be painful to the user and, in some cases, harmful, such as the loss of one or both eyes.

This has resulted in various protectors having been designed in which a transparent acetate visor is mounted integrally with a safety helmet in a manner as to be retracted all the way within or over the helmet. However, these designs have been found costly in that the entire helmet with visor must be replaced whenever the acetate visor is damaged or scratched.

OBJECTS AND STATEMENT OF THE INVENTION

It is an object of the present invention to provide a visor attachment which can be easily mounted to or dismounted from present safety helmets. These helmets have a front part usually displaying a brim which is continuous with a rim extending along both sides and to the back of the helmet; a slot is provided in the rim of each opposite side for securing thereto accessories, such as ear-phones.

The present invention consists in providing a visor attachment for use in combination with these types of helmets that display rim slots. Basically, it consists in mounting a separate visor attachment to the helmet with means for securing the visor in the rim slots, the visor extending over the rear part of the helmet. The helmet is thus worn front-to-back with the visor adapted to extend over the user's face.

The present invention, therefore, relates to a visor attachment for use in combination with a conventional safety helmet having a front brim continuous with a rim extending along each opposite side and the back of the helmet and displaying a slot in the rim of each opposite side thereof; the visor attachment comprises:

(a) a body adapted to be removably mounted to the helmet, including an arcuate portion for covering the back rim of the helmet and a pair of opposite side extensions each including a connecting member adapted to engage a corresponding rim slot and having a releasable portion adapted to engage the rim slot; and (b) a visor pivotally mounted to the body and being retractable between the arcuate portion and the back part of the helmet;

whereby the conventional safety helmet, when combined with the visor attachment, must be worn front-to-back.

The present invention also relates to a visor attachment for use in combination with a conventional safety helmet having a front brim continuous with a rim extending on each opposite side and the rear of the helmet and displaying a rim slot in each opposite side thereof.

The visor attachment comprises: a body adapted to be removably mounted to the helmet, including a brim portion extending along the rear rim of the helmet and a pair of opposite side extensions each including a connecting member adapted to engage a corresponding rim slot of the helmet; the connecting member includes a releasable portion adapted to engage the rim slot. A visor is fixably mounted to the brim portion of the body; link means connect the brim portion to the opposite side extensions allowing the brim portion and the visor to be extended frontwardly to bypass the back rim of the helmet and, then, to be retracted inwardly towards the user's face, whereby the conventional safety helmet, when combined with this visor attachment, is worn front-to-back.

In one preferred form of the invention, the connecting member is formed of a resilient material so that it may be manually moved in and out of engagement with its associated rim slot.

In a further embodiment of the invention, the connecting member has a stepped surface wherein each step is adapted to engage an edge of the rim slot at various heights thereof.

Yet, in another embodiment of the invention, the visor attachment comprises, in each side extension, a slotted connecting member so that accessories, such as ear-phones or the like, may be attached thereto. The presence of these slots on the connecting members is to replace that of the helmet slots which are now used for securing the above-described connecting members.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
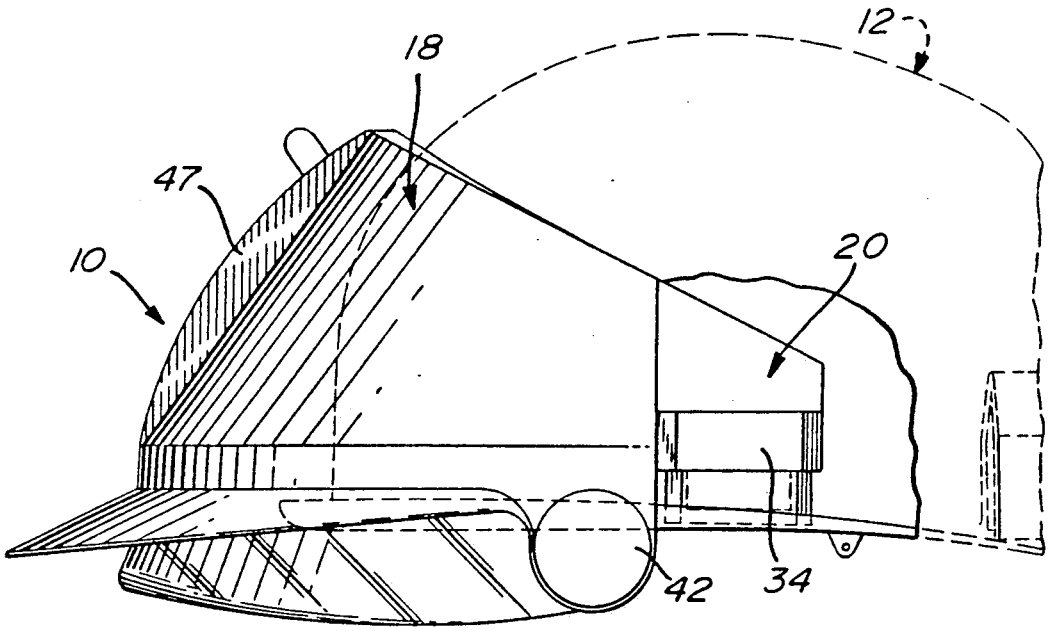
FIG. 1 is a side view of a visor attachment made in accordance with the present invention, being shown mounted at the rear of a conventional safety helmet.
Figure 2:
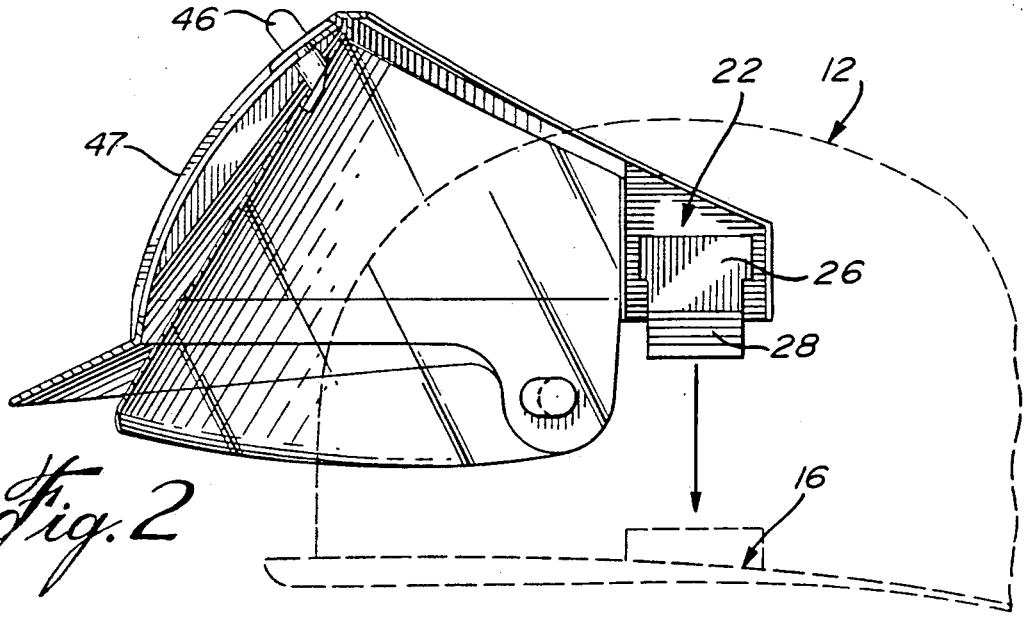
FIG. 2 is an elevational cross-sectional view showing the attachment with the visor in the retracted position within the helmet.
Figure 3:
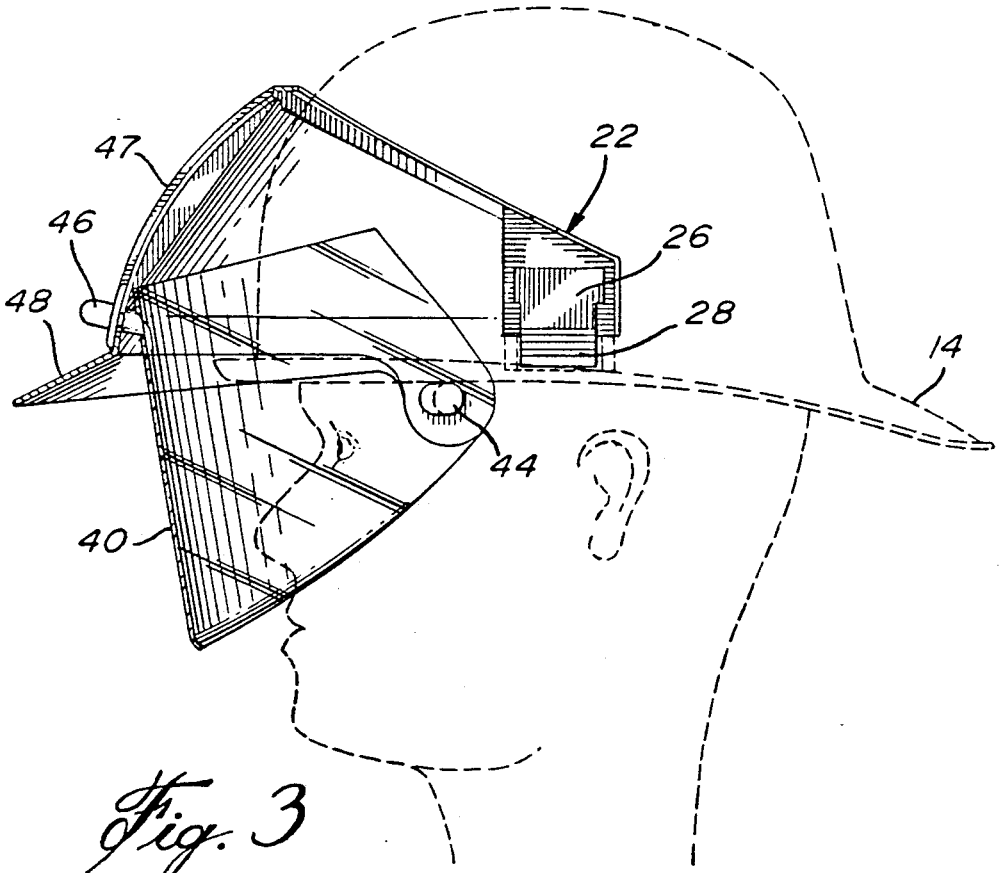
FIG. 3 is a view similar to FIG. 2 showing the visor in the downward eye-covering position.

Referring to FIGS. 1-3, there is shown a first embodiment of a visor attachment, generally denoted 10, being mounted at the back of a safety helmet 12. The front of the helmet has a brim 14 (see FIG. 3) which projects rearwardly when the safety helmet is used in combination with the visor attachment of the present invention. This brim is continuous with a rim that extends along both sides of the helmet and to the back thereof.

Most conventional safety helmets include, in the rim of each opposite side thereof, longitudinally extending rectangular slots 16. The present invention is particularly addressed to these types of helmets.

The visor attachment 10 comprises a body defined by an arcuate front portion 18 and a pair of side extensions 20 and 22, each extending rearwardly adjacent a corresponding rim slot 16.

Figure 4:
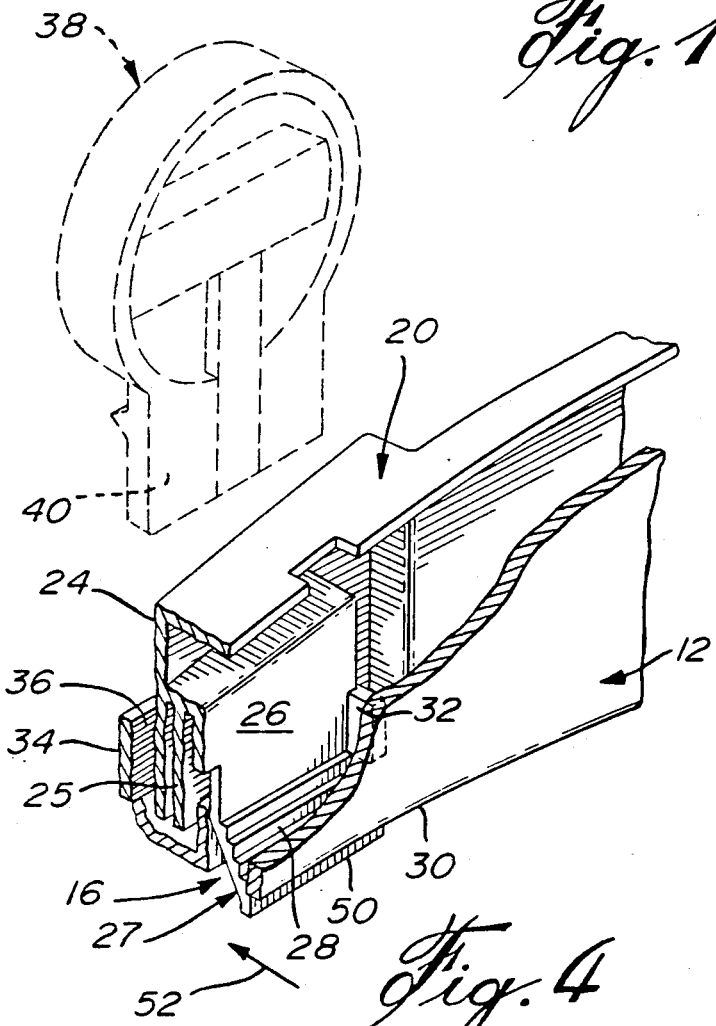
FIG. 4 is an enlarged perspective view, partly sectional, showing part of the side extension of the visor attachment in engagement with an associated part of the safety helmet (this figure is shown on the sheet illustrating FIG. 1)

As illustrated in FIG. 4, each side extension comprises a connecting member 24 which is defined by an intermediate reinforcing wall 25 and an inner wall 26, the lower part 27 of which, has a downwardly extending stepped surface 28 which is adapted to slide in and out of rim slot 16 of the helmet. The steps are configured to engage an edge 30 of the rim slot. This stepped surface allows for various height adjustments of the visor attachment relative to the helmet. A block 32 ensures a tight engagement between the visor attachment 10 and the helmet 12.

The outer wall of the connecting member 24 displays an integral outwardly projecting U-shaped member 34 defining a further slot 36 in which may be received various accessories, such as ear-phones 38 having a lower part 40 engageable with the slot. The purpose of slots 36 is to replace that of slots 16 which are now used for mounting the visor attachment to the safety helmet.

The visor attachment 10 also comprises a transparent acetate visor 40 which is pivotally connected at hinges 42 and 44 to the lower rear part of the arcuate body 18. A finger-gripping lever 46 is secured to the upper part of the visor 40 and protrudes through a vertical slot defined in a rounded projecting part 47 centrally provided on the arcuate portion 18 of the body.

The visor attachment also includes a brim 48 similar to brim 14 found on conventional safety helmets.

Thus, the visor attachment of the present invention may easily be mounted to a conventional safety helmet by a simple downward sliding engagement of the stepped surfaces 28 into their corresponding rim slots 16 of the safety helmet. Referring to FIG. 4, the removal of the visor attachment 10 is easily carried out by applying inward pressure (in the direction of arrow 52) on the lower edge 50 of the stepped surface, thus freeing it from the lower edge 30 of the slot and, then, by upwardly removing the visor attachment from the slot.

Figure 5:
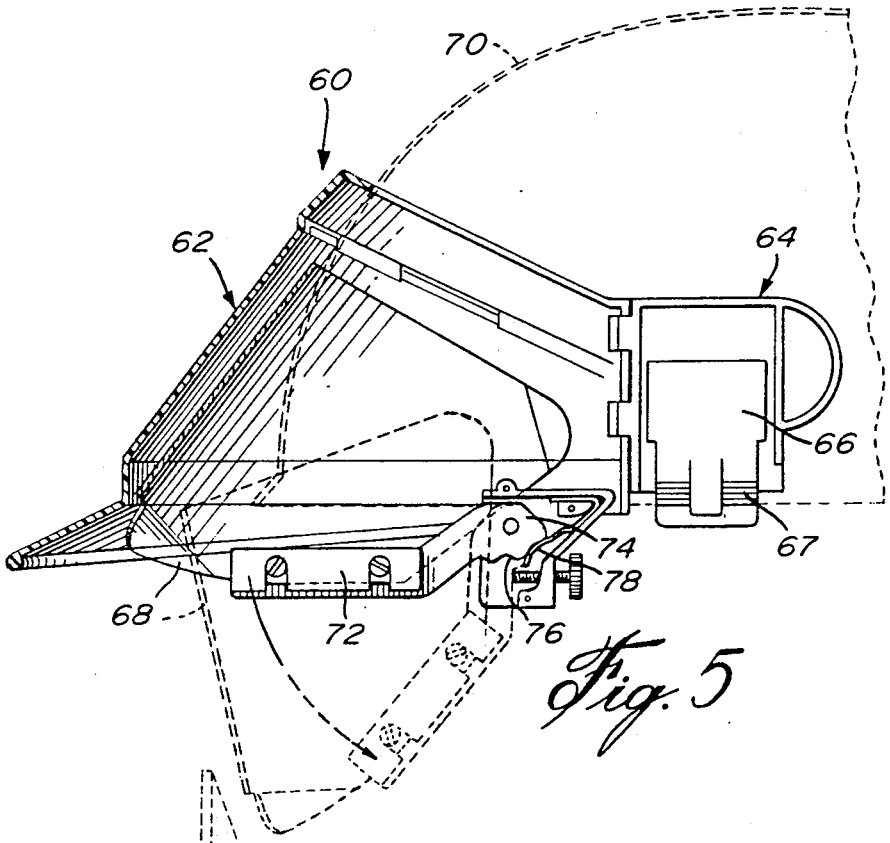
FIG. 5 is an elevational cross-sectional view illustrating a second embodiment of the present invention.

Referring to FIG. 5, there is shown an other embodiment 60 of a visor attachment made in accordance with the present invention. It comprises an arcuate portion 62 with a pair of side extensions, one of which is shown as 64. The side extensions each have an inner depending wall 66 with a stepped surface 67 which is adapted to engage the rim slot of a safety helmet 70 in a manner similar to that described above in relation to FIG. 4. The visor attachment 60 also includes an acetate visor 68 which is adapted to pivot in and out of position between the arcuate portion 62 and the helmet 70. In this embodiment, the visor 68 is equipped with a pair of finger-gripping members 72 along the lower edge of the visor on opposite sides thereof to allow the user to manually move the visor between both positions, as shown by the full and the dotted lines. Each member 72 has a rear portion 74 with a surface 76 defining a pair of curved recesses adapted to receive the correspondingly curved surface of a spring member 78 which serves to secure the visor in the retracted position (shown in full lines) or in the eye-covering position (shown in dotted lines).

Figure 6:
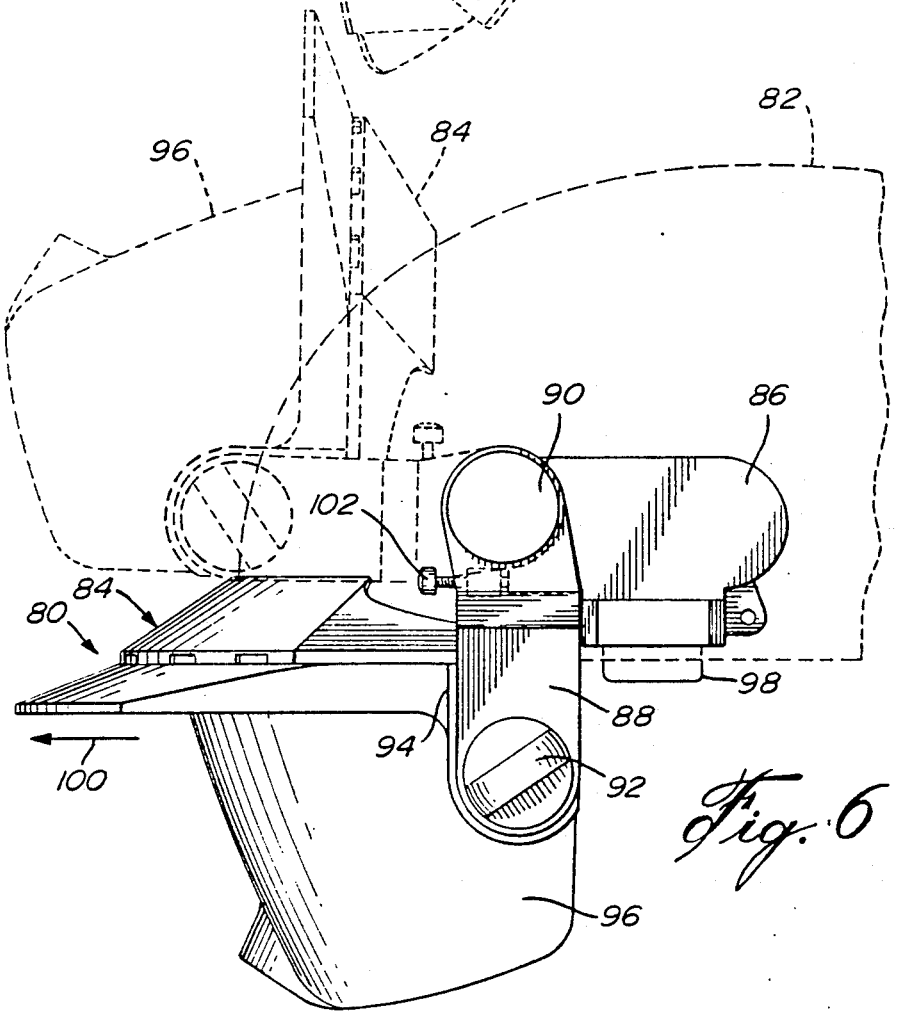
FIGS. 6 and 7 are elevational views showing two positions of a third embodiment of the present invention.
Figure 7:
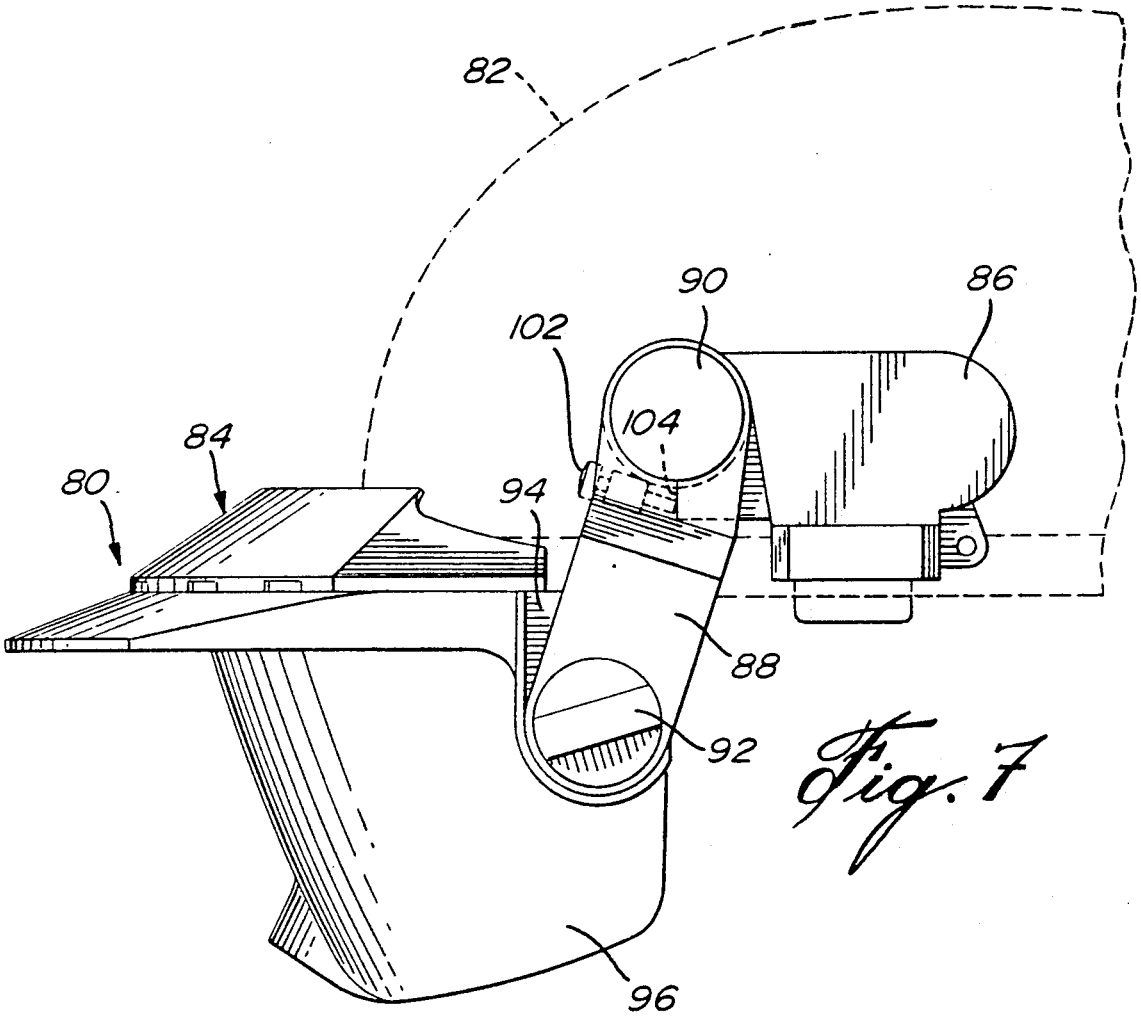

The present invention is also adaptable with visors which are moved from an "up" position, above the brim of a safety helmet, to a "down" position below the brim (bypassing the brim) and inwardly thereof (towards the face of the user). FIGS. 6 and 7 illustrate such a visor attachment 80 which is adapted to be mounted to a safety helmet 82 and which comprises a narrow arcuate portion 84 linked to a connecting member 86 through an arm 88. The latter has a first pivot connection 90, at one end thereof, connecting it to the connecting member 86 and a second pivot connection 92, at the opposite end thereof, connecting it to the side extension 94 of the arcuate portion 84. In this embodiment, the visor 96 is fixably attached to the arcuate portion 84 so that the movable parts, due to the actuation of the linking arm 88, are the arcuate portion and the visor. The connecting member 86 is structurally and functionally similar to the connecting member 20 illustrated in FIG. 4 so that the visor attachment may be removably mounted to the rear part of a helmet by inserting its downwardly depending wall 98 (corresponding to wall 26 in FIG. 4) in its corresponding slot in the rim of the helmet.

For the visor attachment 80 to move from the position shown by the full lines in FIG. 6 to the position shown by the dotted lines, the arcuate body 84 with its visor 96, must first be moved outwardly in the direction indicated by arrow 100 so that the arcuate body may bypass the back rim (not shown) of the helmet. This outward horizontal movement is permitted by the two pivots 90 and 92.

The user may adjust the relative position of the visor to his face by actuating screw 102 which has on end resting against a surface 104 at the frontmost end of the connecting member 86.

Although the invention has been described with respect to three specific forms, it will be evident to a person skilled in the art that it may be refined and modified in various ways. It is therefore wished to have it understood that the present invention should not be limited in interpretation except by the terms of the following claims.

What is claimed is:

1. A visor attachment for use in combination with a conventional safety helmet having a front brim continuous with a rim extending along each opposite side and the back of the helmet and displaying a slot in the rim of each opposite side thereof, said visor attachment comprising:

(a) a body adapted to be removably mounted to the helmet, including an arcuate portion for covering the back rim of the helmet and a pair of opposite side extensions each including, on an inner face thereof, a connecting member adapted to engage a corresponding rim slot of the helmet and, on an outer face thereof, slot means adapted to receive accessories associated with the use of the safety helmet; said connecting member including a releasable portion adapted to engage the rim slot; and (b) a visor pivotally mounted to said body and being retractable between said arcuate portion and the back part of the helmet; whereby said conventional safety helmet, when combined with said visor attachment, is worn front-to-back.

2. A visor attachment as defined in claim 1, wherein said connecting member is formed of resilient material so as to be manually moved in and out of engagement with said corresponding rim slot.

3. A visor attachment as defined in claim 2, wherein said releasable portion to said connecting member defines a stepped surface in which each step is adapted to engage an edge of said rim slot.

4. A visor attachment as defined in claim 1, further comprising means on said visor for retracting said visor in and out of said arcuate portion.

5. A visor attachment as defined in claim 4, further comprising a central slot vertically extending in said arcuate portion and finger-engaging means connected to said visor and protruding through said slot for manipulation of said visor relative to said body.

6. A visor attachment as defined in claim 4, wherein said retracting means consist of a pair of attachments mounted to an edge of said visor on opposite sides thereof.

7. A visor attachment as defined in claim 6, wherein said attachments include rearward extensions pivotally mounted to said body; further comprising means in said rearward extensions for maintaining said visor in an open or in a hidden position relative to said arcuate portion.

8. A visor attachment as defined in claim 1, wherein said arcuate portion includes a brim along the lower edge thereof.

9. A visor attachment for use in combination with a conventional safety helmet having a front brim continuous with a rim extending along each opposite side and the back of the helmet and displaying a slot in the rim of each opposite side thereof, said visor attachment comprising: a body adapted to be removably mounted to the helmet, including a brim portion extending adjacent the rim at the back of the helmet and a pair of opposite side extensions each including, on an inner face thereof, a connecting member adapted to engage a corresponding rim slot of the helmet and, on an outer face thereof, slot means adapted to receive accessories associated with the use of the safety helmet; said connecting member including a releasable portion adapted to engage the rim slot; a visor fixably mounted to said brim portion of said body; and means linking said brim portion to said opposite side extensions allowing said brim portion and said visor to be extended frontwardly to bypass the back rim of said helmet and, then, to be retracted inwardly towards a user's eyes, whereby said conventional safety helmet, when combined with said visor attachment, is worn front-to-back.

10. A visor attachment as defined in claim 9, wherein said connecting member is formed of resilient material so as to be manually moved in and out of engagement with said corresponding rim slot.

11. A visor attachment as defined in claim 10, wherein said releasable portion of said connecting member defines a stepped surface in which each step is adapted to engage an edge of said rim slot.

12. A visor attachment as defined in claim 9, wherein said linking means each consist of an arm having one end pivotally mounted to said connecting member and an opposite end pivotally mounted to said brim portion.

* * * * *